US011619080B2

(12) United States Patent
Minnich

(10) Patent No.: US 11,619,080 B2
(45) Date of Patent: Apr. 4, 2023

(54) MULTI-POINT LATCHING SYSTEM

(71) Applicant: Southco, Inc., Concordville, PA (US)

(72) Inventor: David A. Minnich, Lincoln University, PA (US)

(73) Assignee: Southco, Inc., Concordville, PA (US)

( * ) Notice: Subject to any disclaimer, the term of this patent is extended or adjusted under 35 U.S.C. 154(b) by 114 days.

(21) Appl. No.: 16/772,525

(22) PCT Filed: Nov. 30, 2018

(86) PCT No.: PCT/US2018/063220
§ 371 (c)(1),
(2) Date: Jun. 12, 2020

(87) PCT Pub. No.: WO2019/118201
PCT Pub. Date: Jun. 20, 2019

(65) Prior Publication Data

US 2020/0386021 A1 Dec. 10, 2020

Related U.S. Application Data

(60) Provisional application No. 62/599,162, filed on Dec. 15, 2017.

(51) Int. Cl.
*E05C 9/04* (2006.01)
*E05B 83/30* (2014.01)
(Continued)

(52) U.S. Cl.
CPC ..... *E05C 9/046* (2013.01); *E05B 83/30* (2013.01); *E05B 85/22* (2013.01); *E05C 1/006* (2013.01);
(Continued)

(58) Field of Classification Search
CPC ... E05C 9/046; E05C 1/08; E05C 9/10; E05C 9/006; E05C 9/04; E05C 9/043;
(Continued)

(56) References Cited

U.S. PATENT DOCUMENTS 6,120,069 A * 9/2000 Taranto ..... E05B 83/30 292/DIG. 41
6,669,243 B2 * 12/2003 Katoh ..... B60R 7/06 292/DIG. 37
(Continued)

FOREIGN PATENT DOCUMENTS

CN 101331286 A 12/2008
CN 103814183 A 5/2014
(Continued)

OTHER PUBLICATIONS

International Preliminary Report on Patentability for International Application No. PCI/US2018/063220, dated Jun. 16, 2020, 11 pages.
(Continued)

*Primary Examiner* — Kristina R Fulton
*Assistant Examiner* — Tal Saif
(74) *Attorney, Agent, or Firm* — RatnerPrestia

(57) ABSTRACT

A latching system for securing a door to a panel includes a pawl having a first end that is configured to releasably engage a striker on the panel, and a second end opposite the first end having a connector. A pawl connector is connected to the connector on the second end of the pawl. The pawl connector includes a hollow cylindrical body having a longitudinal axis, a revolved outer side wall extending about the longitudinal axis, an open end through which the connector of the pawl is positioned, an opening defined on the revolved side wall of the cylindrical body, and a deformable portion formed on the revolved outer side wall. The deformable portion extends between the open end and the opening. The deformable portion is configured to elastically deform upon inserting the connector through the open end until the connector is non-removably seated within the opening.

24 Claims, 7 Drawing Sheets

(51) Int. Cl.

| | |
|---|---|
| ***E05B 85/22*** | (2014.01) |
| ***E05C 1/00*** | (2006.01) |
| ***E05C 1/08*** | (2006.01) |
| ***E05C 9/10*** | (2006.01) |

(52) U.S. Cl.
CPC ..... *E05C 1/08* (2013.01); *E05C 9/10* (2013.01); *E05Y 2201/484* (2013.01); *E05Y 2201/638* (2013.01); *E05Y 2201/71* (2013.01); *E05Y 2900/538* (2013.01)

(58) Field of Classification Search
CPC . E05C 9/16; E05C 1/004; E05C 1/006; E05C 1/085; E05C 1/12; E05C 1/14; E05C 1/145; E05C 1/16; E05C 9/20; E05B 83/30; E05B 85/22; E05B 53/28; E05B 53/30; E05B 53/32; E05B 17/0045; E05B 77/36; E05B 77/38; E05Y 2201/484; E05Y 2201/638; E05Y 2201/71; E05Y 2900/538; Y10T 292/0801; Y10T 292/0834; Y10T 292/0837; Y10T 292/0838; Y10T 292/084; Y10T 292/0844; Y10T 292/0845; Y10T 403/55; Y10T 403/60; Y10T 403/606; Y10T 403/251; Y10T 403/325; F16B 7/02; F16B 7/04; F16B 7/0406; F16B 7/0413; F16B 7/042; Y10S 292/38; Y10S 292/53; Y10S 292/54
USPC ..... 403/109.3, 251, 325; 292/80, 81
See application file for complete search history.

(56) References Cited

U.S. PATENT DOCUMENTS

| | | | | |
|---|---|---|---|---|
| 7,634,929 | B2 | 12/2009 | Kuhnke et al. | |
| 9,556,654 | B2 | 1/2017 | Fukumoto | |
| 2004/0017088 | A1* | 1/2004 | Sawatani | E05B 83/30 292/178 |
| 2004/0189012 | A1 | 9/2004 | Katou et al. | |
| 2010/0162522 | A1* | 7/2010 | Han | F16F 9/0254 16/70 |

FOREIGN PATENT DOCUMENTS

| | | | | | |
|---|---|---|---|---|---|
| CN | 103867052 | A | * | 6/2014 | |
| CN | 103867052 | A | | 6/2014 | |
| CN | 205894943 | U | | 1/2017 | |
| CN | 106869639 | A | * | 6/2017 | |
| CN | 106869639 | A | | 6/2017 | |
| EP | 0711375 | A1 | | 5/1996 | |
| KR | 20040041075 | A | * | 5/2004 | E05B 83/30 |

OTHER PUBLICATIONS

International Search Report and Written Opinion for International Application PCT/US2018/063220, dated Feb. 22, 2019, 16 pages.
Indian Examination Report for Indian Application No. 202017025586, dated Apr. 1, 2022, with translation, 6 pages.
Chinese Office Action for Chinese Application No. 201880089422.7, dated Dec. 3, 2021, with translation, 7 pages.
European Communication pursuant to Article 94(3) for European Application No. 18 821 856.4, dated Mar. 30, 2021, 6 pages.

* cited by examiner

MULTI-POINT LATCHING SYSTEM

This application is related to, and claims the benefit of priority of, U.S. Provisional Application No. 62/599,162 filed on 15 Dec. 2017, the contents of which are incorporated by reference in their entirety for all purposes.

FIELD OF THE INVENTION

The present invention relates to the field of latches or connector systems configured to provide a mechanical connection between adjacent components, and particularly to latch systems for securing automotive glove box or accessory compartment doors in a closed position.

BACKGROUND OF THE INVENTION

Automotive closure systems, such as doors, access panels, center consoles, glove boxes and the like, typically include a housing having an opening, a door movably mounted to the housing for either exposing or concealing the opening, and a latch that cooperates with a striker to hold the door in the closed position to cover the opening in the housing. It is important, but sometimes difficult, to provide parts for the closure systems that assemble together with tight tolerances and high final product quality.

It has been found that there is a continuing need to improve upon or provide alternatives to existing closure systems.

BRIEF DESCRIPTION OF THE DRAWINGS

The above and other aspects and features of the present invention will become more apparent to those of ordinary skill in the art by describing in detail exemplary embodiments thereof with reference to the attached drawings.

DETAILED DESCRIPTION OF THE INVENTION

Figure 1A:
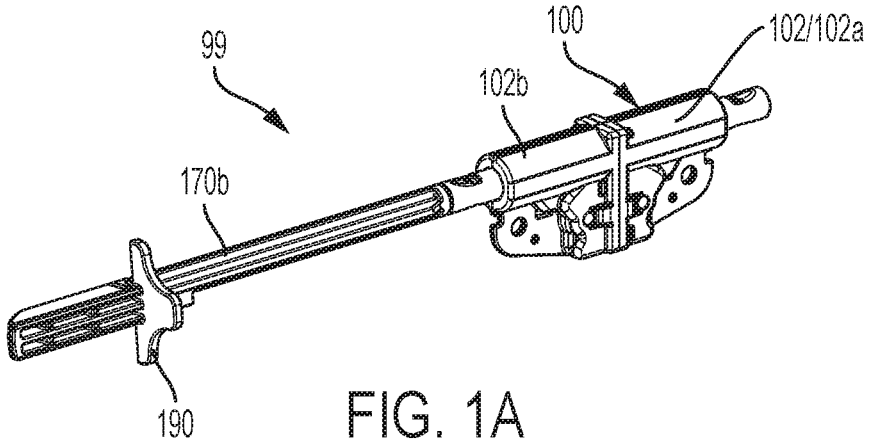
FIG. 1A is a front isometric view of a first exemplary embodiment of a multi-point latching system (the actuator handle, pawl guide bushings and one pawl are not shown).
Figure 1B:
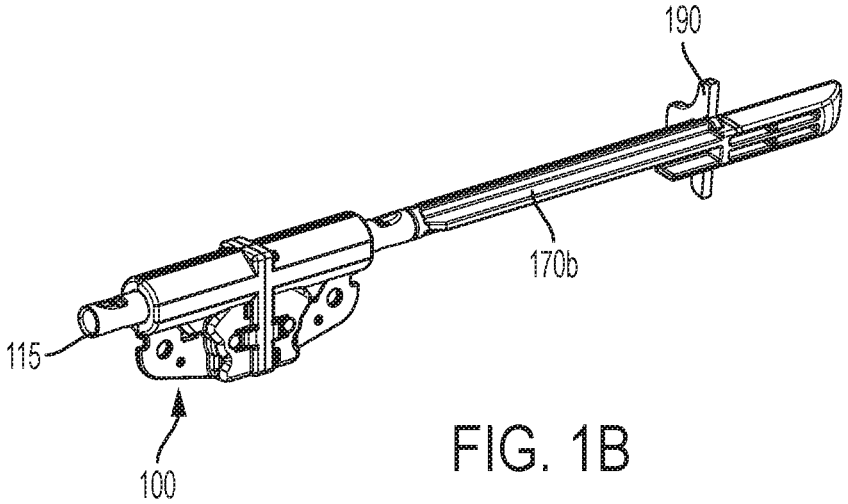
FIG. 1B is a rear isometric view of the multi-point latching system.
Figure 1C:
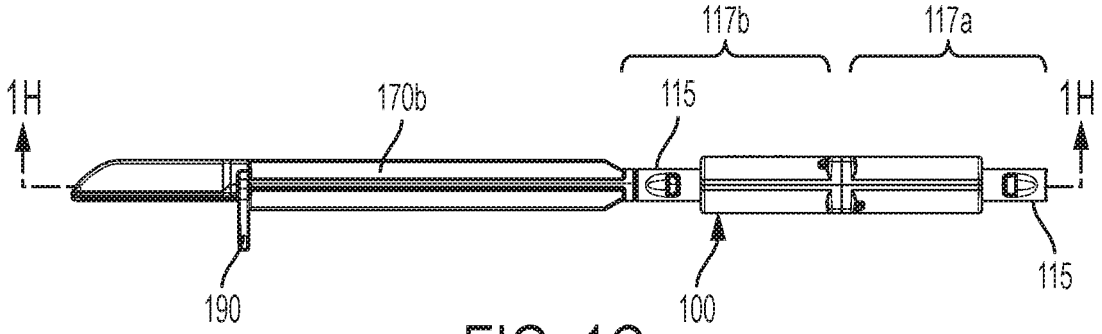
FIG. 1C is a top plan view of the multi-point latching system.

Although the invention is illustrated and described herein with reference to specific embodiments, the invention is not intended to be limited to the details shown. Rather, various modifications may be made in the details within the scope and range of equivalents of the claims and without departing from the invention. In the drawings, like item numbers refer to like elements.

Various terms are used throughout the disclosure to describe the physical shape or arrangement of features. A number of these terms are used to describe features that conform to a cylindrical or generally cylindrical geometry characterized by a radius and a center axis perpendicular to the radius. Unless a different meaning is specified, the terms are given the following meanings. The terms "longitudinal", "longitudinally", "axial" and "axially" refer to a direction, dimension or orientation that is parallel to a center axis. The terms "radial" and "radially" refer to a direction, dimension or orientation that is perpendicular to the center axis. The terms "inward" and "inwardly" refer to a direction, dimension or orientation that extends in a radial direction toward the center axis. The terms "outward" and "outwardly" refer to a direction, dimension or orientation that extends in a radial direction away from the center axis.

In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation.

Terms concerning attachments, coupling and the like, such as "mounted," "connected" and "interconnected," refer to a relationship wherein structures are secured or attached to one another either directly or indirectly through intervening structures, as well as both movable or rigid attachments or relationships, unless expressly described otherwise.

A first embodiment of a multi-point latching system 99 is illustrated in FIGS. 1A-1M. The multi-point latching system 99 generally includes a latch assembly 100 and two pawls 170*a* and 170*b* (only pawl 170*b* is shown in FIGS. 1A-1L) mounted to opposing sides of the latch assembly 100. Although not shown, the multi-point latching system 99 may also include the door, panel or opening to which it is mounted. Additionally, the actuator handle, the pawl guide bushings, and the strikers are not shown.

The latch assembly 100 generally includes a two-piece housing 102 comprising substantially identical housing parts 102*a* and 102*b*. Although only housing part 102*a* will be described hereinafter, it should be understood that the following explanation also applies to housing part 102*b*.

Figure 1D:
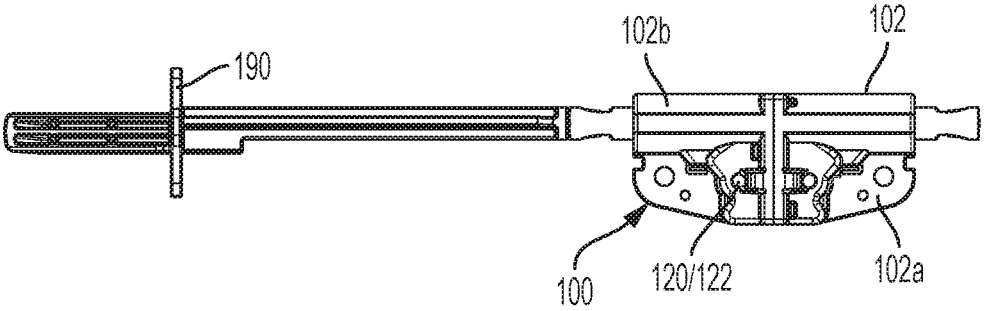
FIG. 1D is a front elevation view of the multi-point latching system.
Figure 1E:
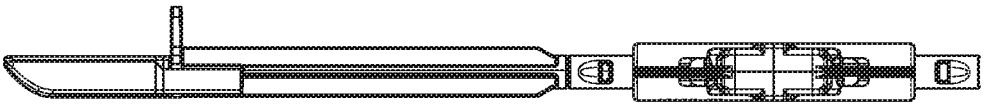
FIG. 1E is a bottom plan view of the multi-point latching system.
Figure 1F:
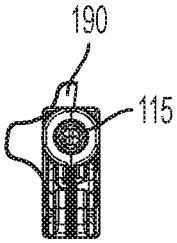
FIG. 1F is a right-side elevation view of the multi-point latching system.
Figure 1G:
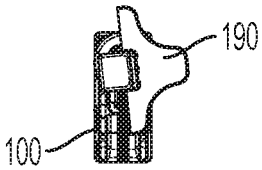
FIG. 1G is a left-side elevation view of the multi-point latching system.
Figure 1H:
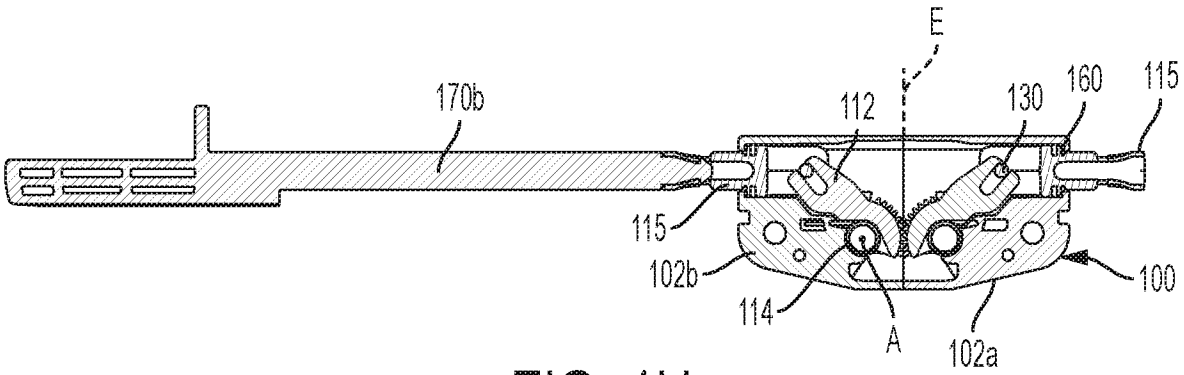
FIG. 1H is a cross-sectional side elevation view of the multi-point latching system of FIG. 1C taken along the lines 1H-1H.
Figure 1I:
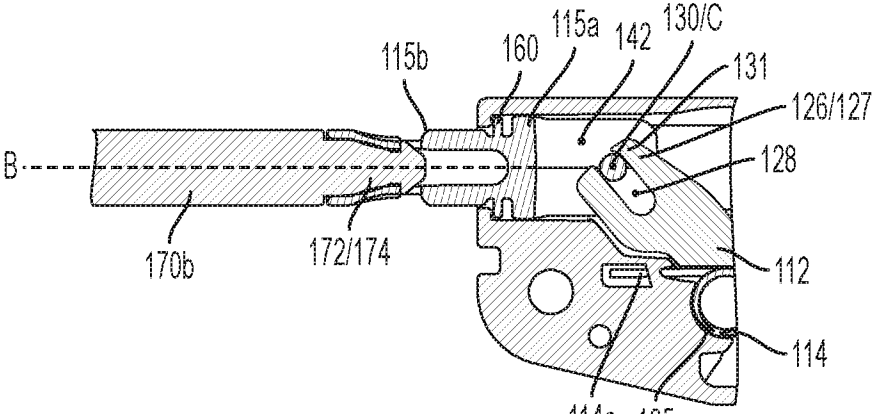
FIG. 1I is a detailed view of the multi-point latching system of FIG. 1H.
Figure 1J:
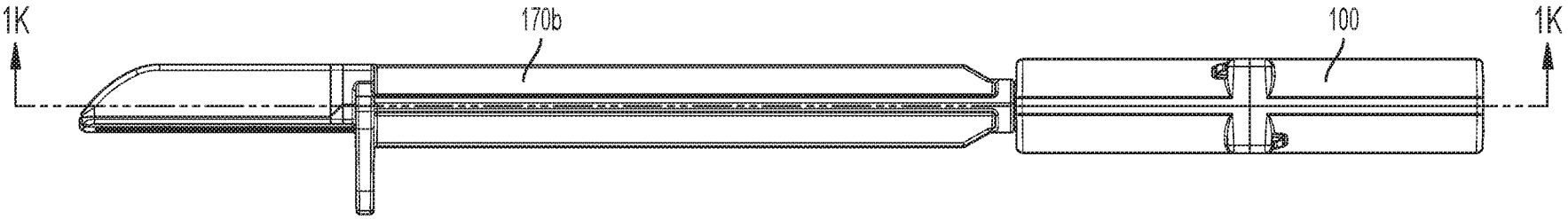
FIG. 1J is a top plan view of the multi-point latching system, wherein the pawl is shown in a retracted position.
Figure 1K:
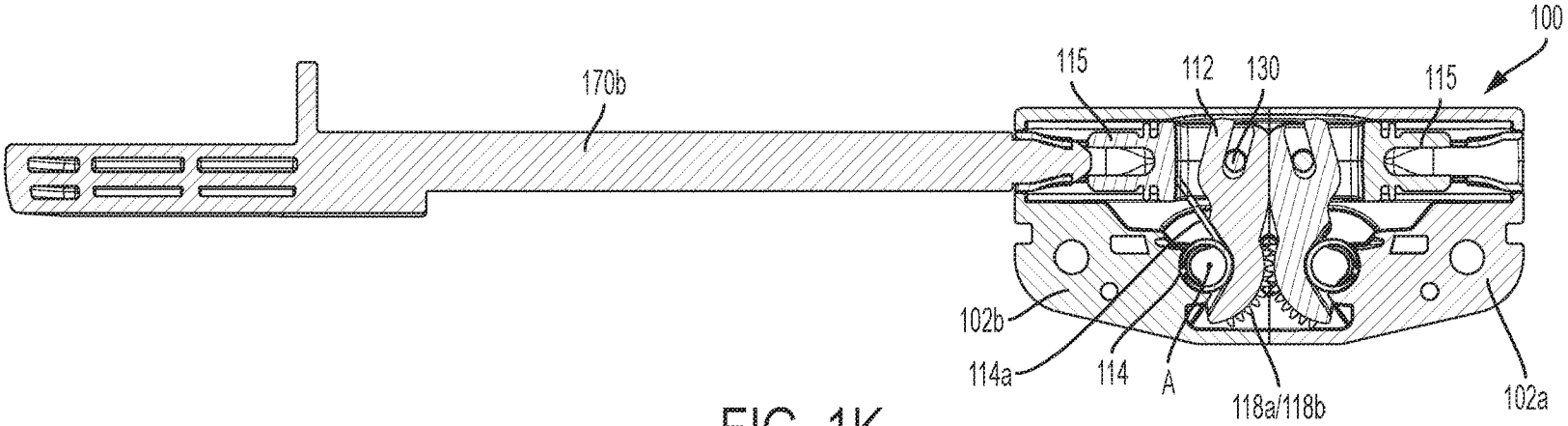
FIG. 1K is a cross-sectional side elevation view of the multi-point latching system of FIG. 1J taken along the lines 1K-1K.
Figure 1L:
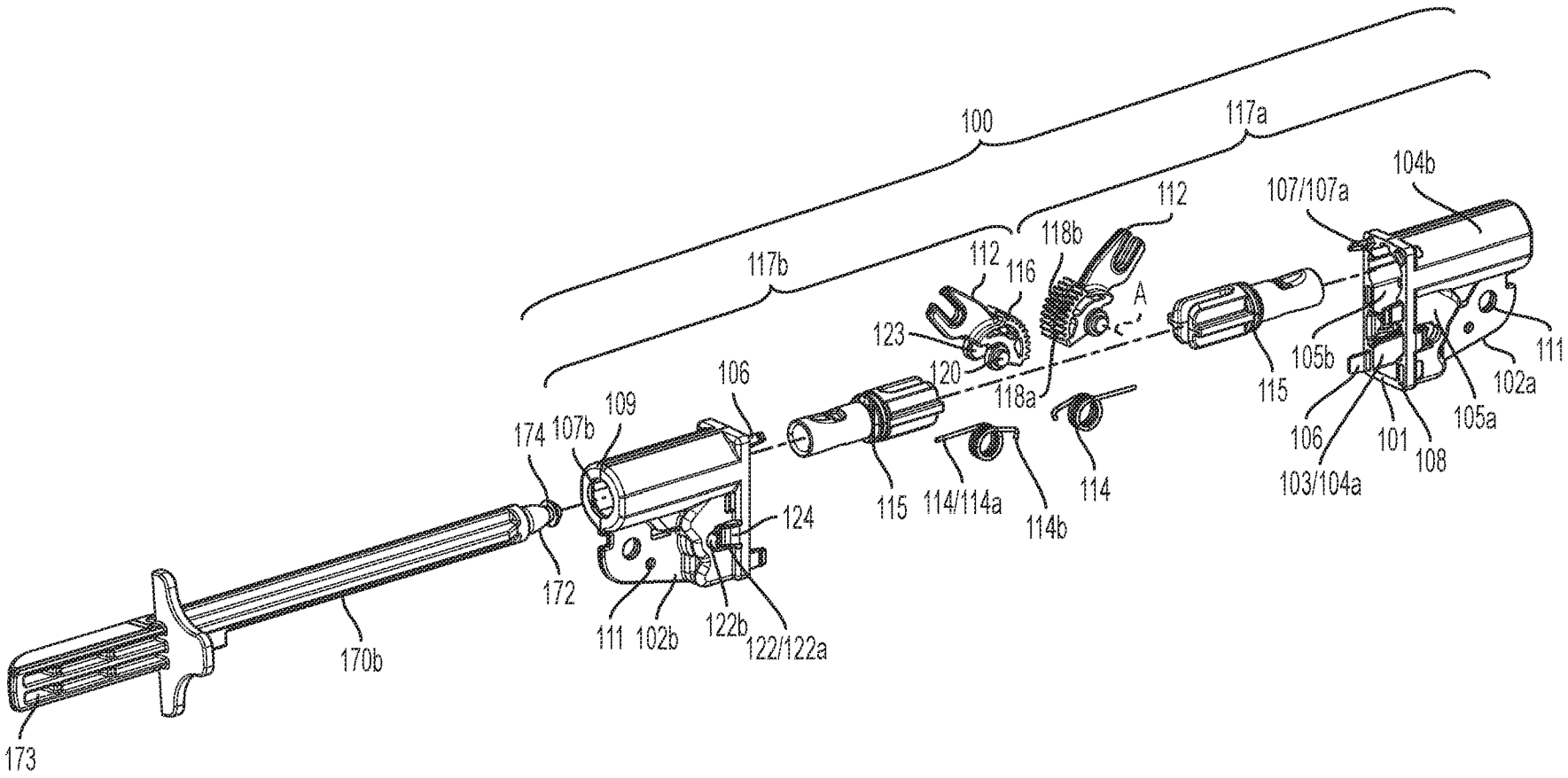
FIG. 1L is an exploded view of the multi-point latching system.

As best shown in FIG. 1L, the housing part 102*a* includes a flange 101 having an open end 103. A lower portion 104*a* and an upper cylindrical portion 104*b* each extend from the open end 103. At least a portion of both the lower portion 104*a* and the upper cylindrical portion 104*b* have opposite side walls 105*a* and 105*b*, which define a hollow space therebetween for accommodating components of the latch assembly 100.

The upper cylindrical portion 104*b* has a hole 107 extending through the housing part 102*a*. The hole 107 has a large diameter first hole portion 107*a* extending from the open end 103, and a small diameter second hole portion 107*b* (i.e., smaller than the first hole portion 107*a*) extending through the upper cylindrical portion 104*b* and passing through the outer wall 109 of the housing part 102*a*.

As best shown in FIGS. 1D and 1L, the housing part 102*a* includes an opening 122 defined through both side walls 105*a* and 105*b*. The openings 122 on the housing part 102*a* are axially aligned with each other. Each opening 122 includes a rectangular portion 122*a* and a semi-circular portion 122*b*. The rectangular portion 122*a* is positioned closer to the open end 103 than the semi-circular portion 122*b*. A spring tab 124, which is integrally formed as a wall on the lower portion 104*a*, is positioned over the rectangular portion 122*a* of each opening 122.

The housing part 102*a* includes a series of clips 106 and slots 108 at the open end 103. The clips 106 of the first housing part 102*a* are configured to be inserted into the slots 108 of the second housing part 102*b*, and the clips 106 of the second housing part 102*b* are configured to be inserted into the slots 108 of the first housing part 102*a*, thereby retaining the housing parts 102*a*, 102*b* together.

A series of openings 111 are provided on each housing part 102*a* and 102*b* for mounting the latch assembly 100 to a glove box, door or panel, for example.

Mounted within the interior space of each housing part 102*a*, 102*b* is a cam 112, a torsion spring 114, and a pawl connector 115. The housing part 102*a*, a first pawl connector 115, a first cam 112 and a first torsion spring 114 form a sub-assembly 117*a*; whereas the housing part 102*b*, a second cam 112, a second pawl connector 115, and a second torsion spring 114 form a sub-assembly 117*b*.

Although the details of only sub-assembly 117*a* will be described hereinafter, it will be understood by those skilled in the art that the sub-assembly 117*b* is substantially identical to the sub-assembly 117*a*.

The torsion spring 114 is a unitary component having a coiled segment and two legs 114*a* and 114*b* extending in opposite directions from the coiled segment. The spring force of the torsion spring 114 may be selected to achieve smooth and quiet motion of the cam 112 and the pawl connector 115 to which the spring 114 is either directly or indirectly connected. The torsion spring 114 may be an off-the-shelf component, if so desired. It is noted that the spring force of the torsion spring 114 of one sub-assembly 117*a* can differ from that of the other sub-assembly 117*b*.

The cam 112 is a unitary body comprising a semi-circular portion 116 having a longitudinal and rotational axis 'A.' The rounded exterior surface of the semi-circular portion 116 includes two sets of gear teeth 118*a* and 118*b*. The edges of the gear teeth 118*a*/118*b* are oriented parallel to the axis 'A.' The gear teeth 118*a* and 118*b* of the cam 112 of the sub-assembly 117*a* are configured to engage and mesh with the gear teeth 118*a* and 118*b* of the cam 112 of the sub-assembly 117*b*. Accordingly, rotation of one cam 112 in one rotational direction about axis 'A' (see FIGS. 1L and 1K) causes rotation of the other cam 112 in an opposite rotational direction about axis 'A'.

The gear teeth 118*a* are a half pitch offset from the gear teeth 118*b*. Accordingly, the same cam 112 can be used for each sub-assembly 117*a*. In assembly, the gear teeth 118 of one cam 112 meshes with the gear teeth 118*b* of another cam 112, and vice versa. Also, meshing the two gear faces offset in that manner reduces the gear backlash in the system relative to the gear modulus.

A post 120 extends in an outward direction along the rotational axis 'A' from each side of the semi-circular portion 116 of the cam 112. An internal pocket 123 (see FIG. 1L) is positioned on the underside of the cam 112 at a position between the two posts 120. The coiled portion of the torsion spring 114 is at least partially positioned in the internal pocket 123 of the cam 112, as well as in a saddle 135 (FIG. 1I) defined on an interior wall of the housing 102. The leg 114*a* of the torsion spring 114 is mounted in a recess (or is positioned on a surface) formed in the hollow interior of the lower portion 104*a* of the housing part 102*a* (see FIG. 1I), whereas the other leg 114*b* of the torsion spring is positioned in the internal pocket 123 of the cam 112.

As best shown in FIG. 1I, a slotted lever 126 is formed on the end of the cam 112 opposite the semi-circular portion 116. The slotted lever 126 includes two arms 127 and a U-shaped channel, slot or opening 128 between the arms 127 for interacting with a cylindrical post 130 on the pawl connector 115.

As best shown in FIG. 1I, a slight return or hook 131 is defined at the interior end of one of the arms 127. The hook 131 is a snap feature that captivates the post 130 on the pawl connector 115 within the slot 128.

Referring now to FIGS. 2A-2F, the pawl connector 115 of the sub-assembly 117*a* has a substantially cylindrical unitized (i.e., monolithic) body including two ends 115*a* and 115*b* extending along a longitudinal axis 'B.' The pawl connector 115 is composed of a flexible, elastic material, such as molded plastic.

Figure 2A:
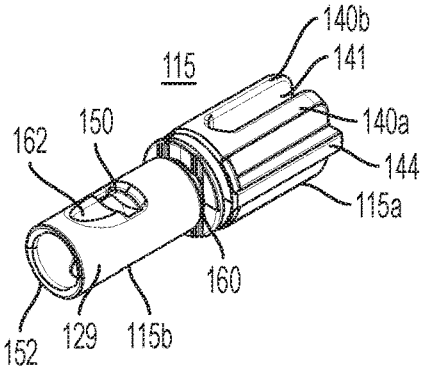
FIG. 2A is an isometric view of one of the pawl connectors of the multi-point latching system of FIG. 1A.
Figure 2B:
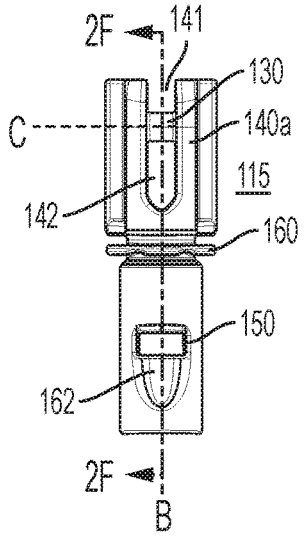
FIG. 2B is a top plan view of the pawl connector of FIG. 2A.
Figure 2C:
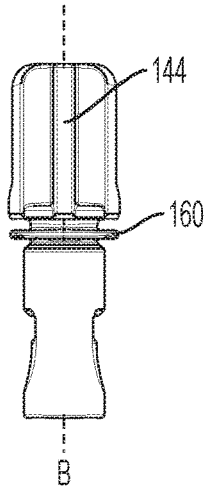
FIG. 2C is a side elevation view of the pawl connector of FIG. 2A.
Figure 2D:
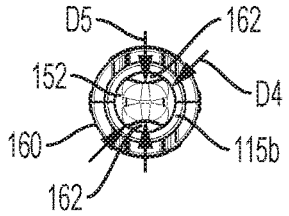
FIG. 2D is a front elevation view of the pawl connector of FIG. 2A.
Figure 2E:
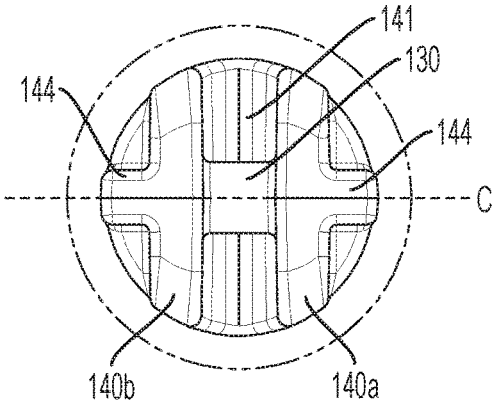
FIG. 2E is an enlarged rear elevation view of the pawl connector of FIG. 2A.

The first end 115*a* of the pawl connector 115 comprises two rectangular ribs 140*a* and 140*b* defining a space 141 therebetween. The cylindrical post 130 of the pawl connector 115 extends between the ribs 140*a* and 140*b*. The post 130 extends along axis 'C,' which is orthogonal to longitudinal axis B, as shown in FIG. 2B. The axis C of the post 130 intersects the longitudinal axis B of the pawl connector 115. The post 130 is positioned such that a space 142 is formed in the pawl connector 115 for receiving and accommodating rotation of the arms 127 of the slotted lever 126. A strengthening rib 144 extends outwardly from the outer surface of each rib 140*a*, 140*b*.

The second end 115*b* of the pawl connector 115 comprises a hollow cylindrical body having a revolved sidewall 129. The second end 115*b* is specially configured to receive a pawl 170. The maximum outer diameter 'D1' of the second end 115*b* is less than the outer diameter 'D2' of the first end 115*a*. The open end 152 of the second end 115*b* of the pawl connector 115 has an interior diameter D4.

Figure 2F:
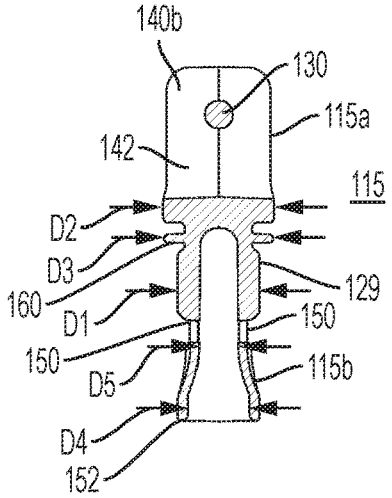
FIG. 2F is a cross-sectional side elevation view of the pawl connector of FIG. 2B taken along the lines 2F-2F.

Two rectangular openings 150 are defined through the sidewall of the pawl connector 115. The centers of the rectangular openings 150 are separated by 180 degrees about the circumference of the second end 115 (as shown in FIG. 2F). In other words, the openings 150 face each other in the circumferential direction. The rectangular openings 150 are axially positioned between the open end 152 of the second end 115*b* and a flange 160. The number and circumferential position of openings 150 can vary from that shown and described while still achieving the same function.

The wall thickness t1 of the portion of the second end 115*b* that bridges the open end 152 and the openings 150 is less than the wall thickness t2 of the portion of the second end 115*b* that bridges the openings 150 and the flange 160.

Figure 1M:
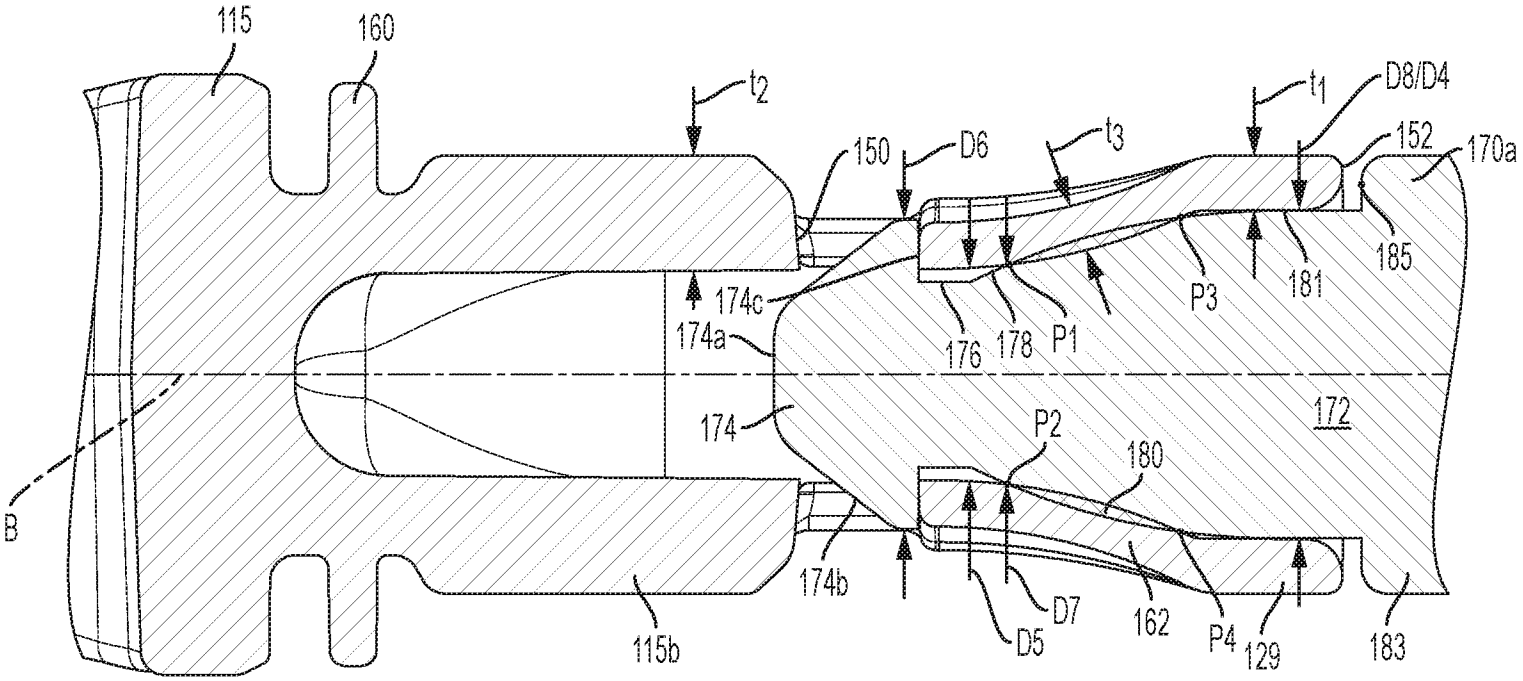
FIG. 1M is a detailed cross-sectional view showing a pawl mounted to the latch assembly of the multi-point latching system of FIG. 1A.

As best shown in FIG. 1M, a deformable portion 162 formed in the sidewall 129 extends in an axial direction from each opening 150 toward the open end 152. Each deformable portion 162 may be a section of reduced thickness t3 as compared with both thicknesses t1 and t2. Each opening 150 and its deformable portion 162 extends 45 degrees, for example, across the circumference of the pawl connector 115.

The section of the second end 115*b* extending from the open end 152 to the openings 150 has an interior diameter D4, with the exception that the interior diameter decreases in the region of the deformable portions 162. The minimum interior distance D5 from one deformable portion 162 to the other deformable portion 162 is less than the interior diameter D4. Also, the distance D5 from one opening 150 to the other opening 150 is less than the interior diameter D4. Stated differently, the interior diameter D4 of the second end 115*b* gradually decreases (as viewed in a direction from the open end 152 toward the opening 150) to an interior distance D5, which is less than interior diameter D4.

As will be described later, the deformable portions 162 are employed for captively receiving a barb connector 174 of a pawl 170. Unlike a traditional spring-clip for retaining a pawl, the deformable portions 162 are formed continuously (i.e., without breaks or gaps) on the sidewall 129 of the pawl connector 115.

A flange 160 is disposed between the first and second ends 115*a* and 115*b* of the pawl connector 115. The diameter D3 of the cylindrical flange 160 is greater than the diameter D1 of the second end 115*b* as well as the diameter of the opening 107*a* upper cylindrical portion 104*b* of the housing part 102*a*, 102*b*. The diameter D3 of the cylindrical flange 160 is greater than the diameter of the opening 107*b* of the housing part 102*a* so that the pawl connector 115 does not become detached from the housing 102.

Although not shown, the flange 160 may not extend continuously about the circumference of the pawl connector 115. The flange 160 could include slots or continuity breaks along its circumference in an effort to mitigate noise.

Each pawl 170*a* and 170*b* (referred to either individually or collectively as pawl(s) 170) includes one end 173 (see FIG. 1L) that interacts with a striker (not shown) to keep the door, glove box, or panel in a closed position, and an opposite end 172 that is configured to be connected to the pawl connector 115. The pawl 170*a* is only shown in FIG. 1M, and is omitted from the other views. The pawl end 172 includes a barb connector 174 that is configured to be non-removably inserted into the openings 150 of the pawl connector 115.

As best shown in FIG. 1M, the barb connector 174 includes a bulbous end having a flat leading surface 174*a*, a conical surface 174*b* extending in a trailing direction from the leading surface 174*a*, and an annular surface 174*c* extending from the conical surface 174*b* toward the longitudinal axis B. A shoulder is formed at the annular surface 174*c*.

The diameter of the conical surface 174*b* increases in the trailing direction. The maximum diameter D6 of the conical surface 174*b* is slightly less than the internal diameter D4 of the open end 152 of the pawl connector 115 so that the barb connector 174 can be inserted into the pawl connector 115.

A cylindrical surface 176 extends in the trailing direction from the barb connector 174. A conical surface 178 extends in the trailing direction from the cylindrical surface 176 of the pawl 170. The diameter of the conical surface 178 increases in the trailing direction. A surface 180 extends in the trailing direction from the conical surface 178 of the pawl 170. The surface 180 may be characterized as rounded, concave, conical, ramped, sloping or hourglass shaped. The diameter of the surface 180 also increases in the trailing direction. A cylindrical surface 181 extends in a trailing direction from the surface 180 of the pawl 170. The diameter D8 of the cylindrical surface 181 is slightly less than the diameter D4 at the open end 152 of the pawl connector 115. The cylindrical surface 181 intersects the cylindrical surface 183 of the pawl 170 at a radially extending shoulder 185. The diameter of the cylindrical surface 183 is greater than that of the cylindrical surface 181 and the diameter D4 at the open end 152 thereby preventing the cylindrical surface 183 from entering the open end 152 of the pawl connector 115.

A leading end of the surface 180 of the pawl 170 is configured to engage the deformable portions 162 at contact points P1 and P2. The contact points P1 and P2 are radially spaced apart by 180 degrees. The diameter D7 at the leading end of the surface 180 of the pawl 170 is slightly greater than the minimum interior distance D5 from one deformable portion 162 to the other deformable portion 162. This ensures that the barb connector 174 directly and physically contacts both deformable portions 162.

A trailing end of the surface 180 of the pawl 170 is configured to engage the deformable portions 162 at contact points P3 and P4. The contact points P3 and P4 trail the contact points P1 and P2. The contact points P3 and P4 are radially spaced apart by 180 degrees.

Physical contact at the contact points P1-P4 reduces movement of the pawls 170 within the housing 102, which either eliminates or reduces audible noise (e.g., squeaks or rattles) and movement between the pawls 170 and the housing 102 produced during operation of the latching system 99.

The pawl 170*b* (only) includes a bearing surface 190. A handle (not shown) is configured to engage the bearing surface 190 of the pawl 170*b* for moving the pawl 170*b* inward (i.e., toward central axis E of housing 102). As will be described later with respect to operation of the latching system 99, moving one pawl 170*b* causes the other pawl 170*a* to move inward. It should be understood that either pawl 170 could include the bearing surface 190.

Alternatively, surface 190 is not actuated by the handle. The surface 190 may be used as an orientation feature to preclude an assembler from installing the pawl 170 out of rotational orientation.

Referring now to the process of assembling the latch assembly 100, the sub-assemblies 117*a* and 117*b* of the latching system 99 are first assembled. The process of assembling only sub-assembly 117*b* will be described hereinafter, however, it should be understood that the process for assembling sub-assembly 117*a* is virtually identical.

To assemble the sub-assembly 117*b*, the coiled portion of the spring 114 is positioned on the housing 102, and the legs 114*a*, 114*b* of the spring 114 are positioned in their respective locations on the housing part 102*b* and the cam 112. The posts 120 of the cam 112 are delivered through the rectangular openings 122*a* of the housing part 102*b* and are ultimately snap-fit into the semi-circular openings 122*b* of a respective opening 122 by the spring tabs 124. More particularly, as the post 120 is moved along the opening 122, the post 120 translates the spring tabs 124 away from the housing part 102*b* until the post 120 clears the spring tabs 124, at which time the spring tabs 124 snap back to their home position, thereby captivating the posts 120 within respective semi-circular openings 122*b*.

The post 130 of the pawl connector 115 is positioned within the slot 128 of the slotted lever 126. The second end 115*b* of the pawl connector 115 is then positioned through the first hole portion 107*a* of the housing part 102*b* until the flange 160 rests on an interior facing side of the wall 109 of the housing part 102*b*. At this time, the second end 115*b* of the pawl connector 115 is positioned through the second hole portion 107*b* in the wall 109 of the housing part 102*b*. The spring 114 biases the second end 115*b* of the pawl connector 115 away from the housing part 102*b* (i.e., away from axis 'E' in FIG. 1H).

As best shown in FIG. 1L, the sub-assembly 117*b* is then assembled and ready for assembly to the other sub-assembly 117*a*. The sub-assemblies 117*a* and 117*b* are joined together by mating the clips 106 and slots 108 on housing part 102*a* of the sub-assembly 117*a* with the slots 108 and the clips 106, respectively, on the housing part 102*b* of the sub-assembly 117*b*. At this time the gear teeth 118*a* and 118*b* of the cam 112 of the sub-assembly 117*a* are meshed with the gear teeth 118*a* and 118*b* of the cam 112 of the sub-assembly 117*b*.

Although not shown, the sub-assemblies 117 may also be used with latching systems including a middle housing (not shown) that allows for a rack to engaged between the cams 112. This enables the part to be operated either by pushing or pulling on that rack instead of on the pawl portion.

The mated sub-assemblies 117*a* and 117*b* are then mounted to the door or panel. The pawls 170 are then mounted to the door or panel and positioned through respective strikers.

Thereafter, the pawls 170 are assembled onto the pawl connectors 115 protruding from the sides of the housing 102. More particularly, to assemble each pawl 170 onto its respective pawl connector 115, the barb connector 174 is first inserted through the open end 152. As best shown in FIG. 1M, the barb connector 174 is then translated through the opening of the pawl connector 115. As the barb connector 174 is translated through the opening of the pawl connector 115, the conical surface 174*b* simultaneously moves the deformable portions 162 in an outward direction (away from axis B), thereby elastically deforming the deformable portions 162, until the annular surface 174*c* of the barb connector 174 registers with the edge of the opening 150 in the pawl connector 115. Once annular surface 174*c* of the barb connector 174 moves past the edge of the opening 150 in the pawl connector 115, the barb connector 174 enters the opening 150 and the deformable portions 162 move inwardly (toward axis B).

The barb connector 174 is then captivated in the opening 150 of the pawl connector 115, as shown in FIG. 1M. The contact points P1-P4 either limit or prevent the pawl 170 from moving in a forward direction (toward the axis E). The shoulder formed at the annular surface 174*c* of the barb connector 174 either limits or prevents the pawl 170 from moving in a reverse direction (away from the axis E). Thus, the barb connector 174 is then captivated in the opening 150 of the pawl connector 115.

Referring now to the process of operating the latching system 99, the latching system 99 is initially in the deployed state, as shown in FIG. 1H. In the deployed state, the ends 173 of the pawls 170 are engaged with strikers, thereby maintaining a door or panel, to which the latching system 99 is mounted, in a closed position.

To open the door or panel, it is necessary to retract the latching system 99. To retract the latching system 99, the pawl 170*b* is moved inwardly. This may be accomplished by a user moving a handle (not shown) that is connected to the latching system 99. The handle may move the bearing surface 190 of one pawl 170*b* inward (i.e., toward the axis E). Alternatively, the handle may interact with the pawl 170*b* at another location, such as the distal end of the pawl 170*b*. As another alternative, an electrical actuator (not shown) could move the pawl 170*b* inwardly. If a rack (not shown) is provided for moving the cams 112 simultaneously, as briefly described above, then motion of the rack could be controlled a handle or electrical actuator. In summary, the pawl 170*b* (and/or 170*a*) could be moved by a wide variety of mechanisms.

Nevertheless, moving the pawl 170*b* inward causes pawl connector 115 to move inwardly, which causes rotation of the cam 112 of the sub-assembly 117*b* (by virtue of the sliding engagement between the post 130 of the pawl connector 115 and the slot 128 of the slotted lever 126) in a clockwise direction and against the bias of the spring 114. Rotation of the cam 112 of the sub-assembly 117*b* in a clockwise direction causes rotation of the cam 112 of the sub-assembly 117*a* in a counter clockwise direction, and against the bias of the spring 114 of the sub-assembly 117*a*, by virtue of the meshed engagement between the gears 118*a* and 118*b* of those two cams 112. Rotation of the cam 112 of the sub-assembly 117*a* in the counter clockwise direction causes the slotted lever 126 of the sub-assembly 117*a* to translate the post 130 along with the entire pawl connector 115 of the sub-assembly 117*a* inwardly (i.e., toward the axis E). Inward translation of the pawl connector 115 of the sub-assembly 117*a* causes the pawl 170*b* to move inwardly. Inward translation of both pawls 170 causes the pawls 170 to disengage from their respective strikers, thereby permitting the door, glove box or panel, to which the latch assembly 100 is attached, to be opened. The retracted state of the latching system 99 is shown in FIGS. 1J and 1K.

It should be understood that the above-described movements of the latching system 99 occur substantially simultaneously.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A latching system, the latching system comprising:

a pawl having a first end, and a second end opposite the first end and having a connector;

a pawl connector that is connected to the connector on the second end of the pawl, wherein the pawl connector includes a hollow cylindrical body having a longitudinal axis, a revolved outer side wall extending about the longitudinal axis, an open end through which the connector of the pawl is positioned, an opening defined on the revolved side wall of the cylindrical body, and a deformable portion formed on the revolved outer side wall, the deformable portion extending between the open end and the opening, the deformable portion being configured to elastically deform upon inserting the connector through the open end until the connector is non-removably seated within the opening, wherein the deformable portion is a portion of the sidewall of the pawl connector that extends from the open end to the opening and is formed continuously and without gaps about the longitudinal axis, and wherein an interior diameter of the sidewall decreases in a direction from the open end to the opening.

2. The latching system of claim 1, further comprising a spring for biasing the pawl connector.

3. The latching system of claim 1, wherein the deformable portion intersects the opening and is spaced from the open end.

4. The latching system of claim 1, further comprising a second opening defined on the revolved side wall of the cylindrical body and positioned radially opposite said opening on the revolved side wall, wherein the connector is also non-removably seated in the second opening.

5. The latching system of claim 4, further comprising a second deformable portion formed on the revolved outer side wall and positioned radially opposite said opening on the revolved side wall, wherein the second deformable portion extending between the open end and the second opening.

6. The latching system of claim 5, wherein a straight line distance between the deformable portions is less than an interior diameter at the open end of the pawl connector.

7. The latching system of claim 1, wherein the deformable portion is angled toward the longitudinal axis as viewed in a direction from the open end toward the opening.

8. The latching system of claim 1, wherein the deformable portion extends across a portion of an outer perimeter of the pawl connector.

9. The latching system of claim 1 further comprising a housing defining an interior region in which at least a portion of the pawl connector is positioned.

10. The latching system of claim 9, wherein the pawl connector includes a first end that is positioned within the housing and configured to transfer motion from the pawl to another pawl of the latching system, a second end configured to be connected to the pawl, and a flange positioned between the first end and the second end of the pawl connector for preventing the pawl connector from becoming detached from the housing, wherein the pawl connector is a unitary component.

11. The latching system of claim 1, wherein the connector is a barb connector.

12. A latching system, the latching system comprising:

two pawls each having a first end, and a second end opposite the first end and having a connector;

two pawl connectors each being connected to the connector of one of the two pawls, wherein the pawl connectors are either directly or indirectly connected to one another such that motion of one of the two pawls causes motion of the other of the two pawls;

wherein each pawl connector includes a hollow cylindrical body having a longitudinal axis, a revolved outer side wall extending about the longitudinal axis, an open end through which the connector of one of the two pawls is positioned, at least two openings defined on the revolved side wall of the cylindrical body, and at least two deformable portions formed on the revolved outer side wall, each deformable portion extending between the open end and one of the at least two openings, each deformable portion being configured to elastically deform upon inserting the connector of said one of the two pawls through the open end until the connector of said one of the two pawls is non-removably seated within the two openings, wherein the deformable portion is a portion of the sidewall of each pawl connector extending from the open end to the openings and is formed continuously and without gaps about the longitudinal axis, and wherein an interior diameter of the sidewall decreases in a direction from the open end to the opening.

13. The latching system of claim 12 further comprising a housing defining an interior region in which at least a portion of each pawl connector is positioned.

14. The latching system of claim 13, wherein each pawl connector includes a first end that is positioned within the housing and configured to transfer motion from said one of the two pawls to the other pawl, a second end connected to one of the two pawls, and a flange positioned between the first end and the second end of the pawl connector for preventing the pawl connector from becoming detached from the housing, wherein the pawl connector is a unitary component.

15. The latching system of claim 14, wherein the flange is circular.

16. The latching system of claim 12, wherein each connector is a barb connector.

17. The latch assembly of claim 1, the latch system further comprising:

a housing defining an interior space and an interior wall facing the interior space, wherein the pawl connector is positioned at least partially within the interior space of the housing, the pawl connector having a first end that is positioned within the housing and configured to transfer motion from the pawl to another pawl of the latch assembly, a second end configured to be connected to the pawl, and a flange positioned between the first end and the second end of the pawl connector for preventing the pawl connector from becoming detached from the housing, wherein the pawl connector is a unitary component, wherein the flange is configured to limit audible noise upon movement of the pawl connector to a latched position.

18. The latch assembly of claim 17, wherein the flange is circular.

19. The latch assembly of claim 17, wherein the pawl connector is composed of plastic.

20. The latch assembly of claim 17, wherein the flange extends about an entire perimeter of the pawl connector.

21. The latch assembly of claim 1, wherein the deformable portion constitutes a reduced thickness portion of the pawl connector.

22. The latching system of claim 12, wherein each deformable portion constitutes a reduced thickness portion of the respective pawl connector.

23. The latch assembly of claim 1, wherein upon inserting the connector through the open end, the deformable portion moves in a direction away from the longitudinal axis, and once the connector enters the opening, the deformable portion moves in a direction toward the longitudinal axis.

24. The latching system of claim 12, wherein the deformable portion moves in a direction away from the longitudinal axis upon inserting the connector through the open end, and the deformable portion moves in a direction toward the longitudinal axis once the connector enters the opening.

* * * * *